US006758413B1

(12) United States Patent
Chen

(10) Patent No.: US 6,758,413 B1
(45) Date of Patent: Jul. 6, 2004

(54) SPRINKLER

(76) Inventor: Pao-Tien Chen, No. 72-9, Sec. 3, Luhe Road, Lugang Jen, Changhua (TW)

( * ) Notice: Subject to any disclaimer, the term of this patent is extended or adjusted under 35 U.S.C. 154(b) by 0 days.

(21) Appl. No.: 10/387,420

(22) Filed: Mar. 14, 2003

(51) Int. Cl.[7] ..... B05B 7/02; B05B 1/38; B05B 1/14; A62C 31/02; A62C 31/00

(52) U.S. Cl. ..... 239/525; 239/538; 239/550; 239/554; 239/438; 239/443; 239/390

(58) Field of Search ..... 239/525, 390, 239/391, 395, 397, 436, 438, 443, 537, 538, 548, 550, 553.5, 554, 587.1

(56) References Cited

U.S. PATENT DOCUMENTS 163,101 A * 5/1875 Orr ..... 239/533.15
563,454 A * 7/1896 Cunningham ..... 239/443
2,176,699 A * 10/1939 Anderson ..... 239/441
2,801,882 A * 8/1957 Schwemlein ..... 239/458
3,058,670 A * 10/1962 Marotto et al. ..... 239/428.5
3,514,042 A * 5/1970 Freed ..... 239/458
3,784,112 A * 1/1974 Collignon ..... 239/443
5,333,792 A * 8/1994 Wang ..... 239/440

* cited by examiner

*Primary Examiner*—William C. Doerrler
(74) *Attorney, Agent, or Firm*—Rosenberg, Klein & Lee

(57) ABSTRACT

An improved sprinkler includes a spray nozzle, an adjusting sleeve, a barrel set and a hose connector. The barrel set has a barrel to control water discharge of a first water outlet. The adjusting sleeve can control water discharge of a second water outlet. By controlling water discharge of the first and the second water outlets, water spraying may be adjusted according to plant requirements and conditions.

2 Claims, 5 Drawing Sheets

SPRINKLER

BACKGROUND OF THE INVENTION

1. Field of the Invention

The invention relates to an improved sprinkler and particularly to a sprinkler that is allowed to adjust and control spraying water according to various gardening plants.

2. Description of the Prior Art

Referring to FIG. 1, a conventional sprinkler 1 mainly includes a spray nozzle 11, a barrel 12 and a hose connector 13. The spray nozzle 11 is a hollow tube with an inner threaded section 114 for fastening the barrel 12 and a water outlet 111 on the front end. The barrel 12 has a body 120 which has a fender head 123 located on the front end thereof. Behind the fender head 123, there are a conical section 122 and an aperture 121. The body 120 further has a threaded section 124 in the middle section and a turning head 125 of a larger diameter on the rear end thereof for turning and adjusting water discharge amount and controlling shut off of water discharge. The turning head 125 has an inner screw hole 126 to couple with a hose connector 13. The hose connector 13 is a hollow tube which has a front section forming a tubular head of a larger diameter with an inner opening 132 and an outer threaded section 131, and a rear end coupling with a water outlet 134 through a nut 133. As the water outlet 111 of the sprinkler 1 has only one water discharge opening, water is ejected out directly. While the water may be ejected to a greater distance, it also is ejected with a stronger force. It could damage flowers or newly planted young tresses. Thus such a sprinkler is not well received by gardening lovers and horticulturists.

SUMMARY OF THE INVENTION

In view of the aforesaid disadvantages, the primary object of the invention is to provide an improved sprinkler that mainly includes a spray nozzle, an adjusting sleeve, a barrel set and a hose connector. The barrel set has a turning head for controlling water discharge of a first water outlet. The adjusting sleeve can control water discharge of a second water outlet. Thus users can adjust and control the force and amount of water discharge according the plant conditions to overcome the drawbacks of the conventional sprinklers and prevent plant damages that might otherwise occur due to improper watering.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
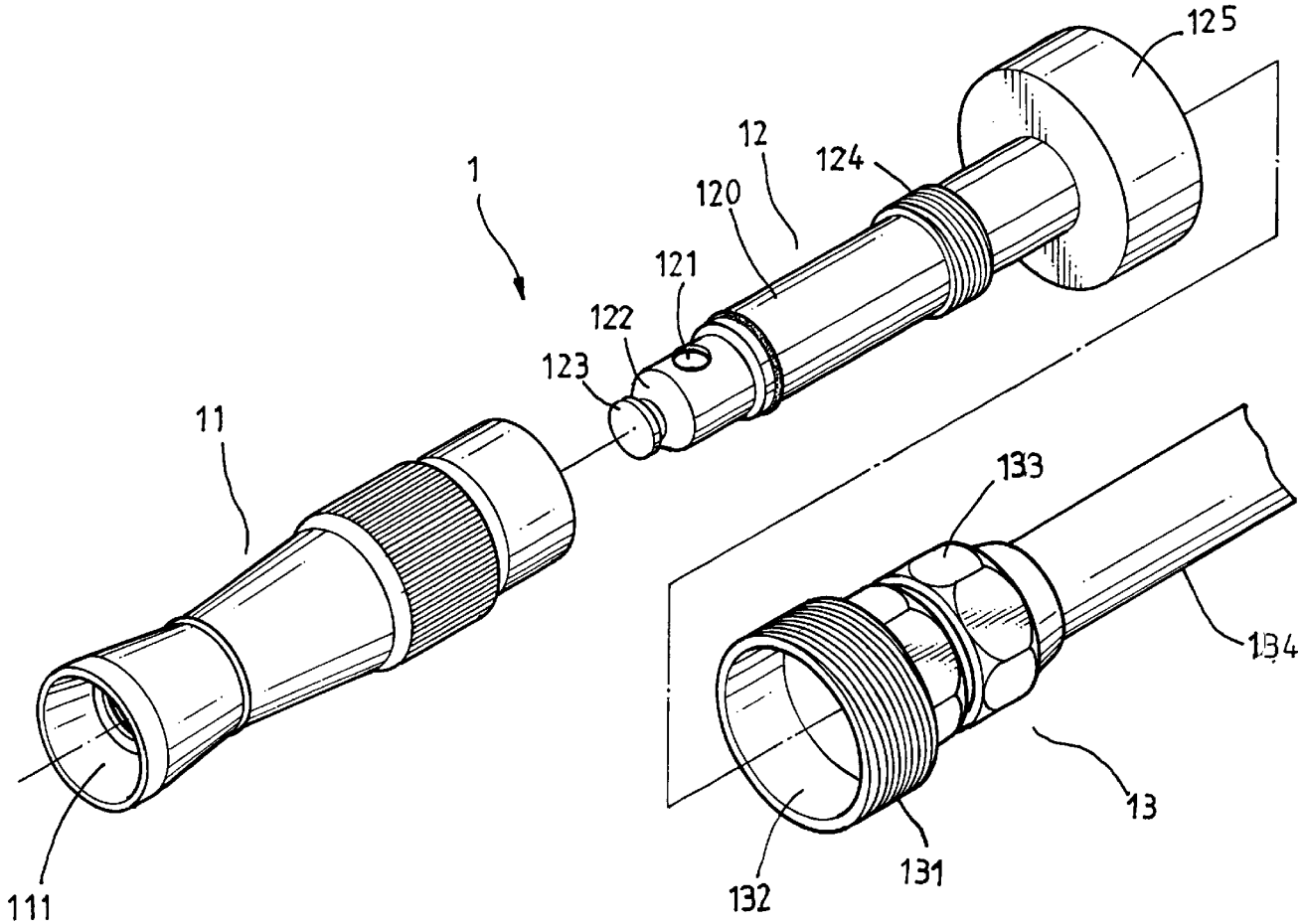
FIG. 1 PRIOR ART
FIG. 1 is an exploded view of a conventional sprinkler.
Figure 2:
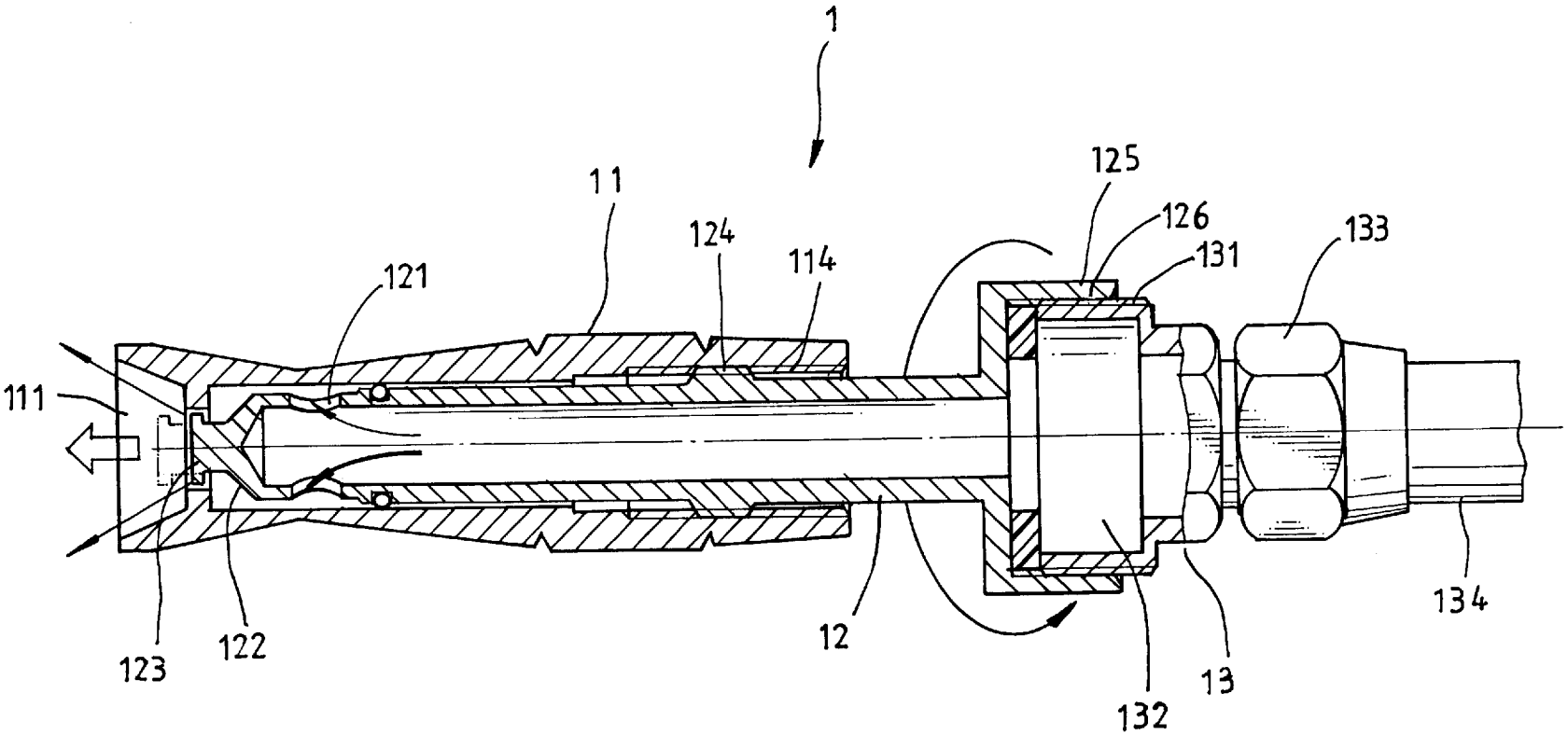
FIG. 2 PRIOR ART
FIG. 2 is a sectional view of a conventional sprinkler.
Figure 3:
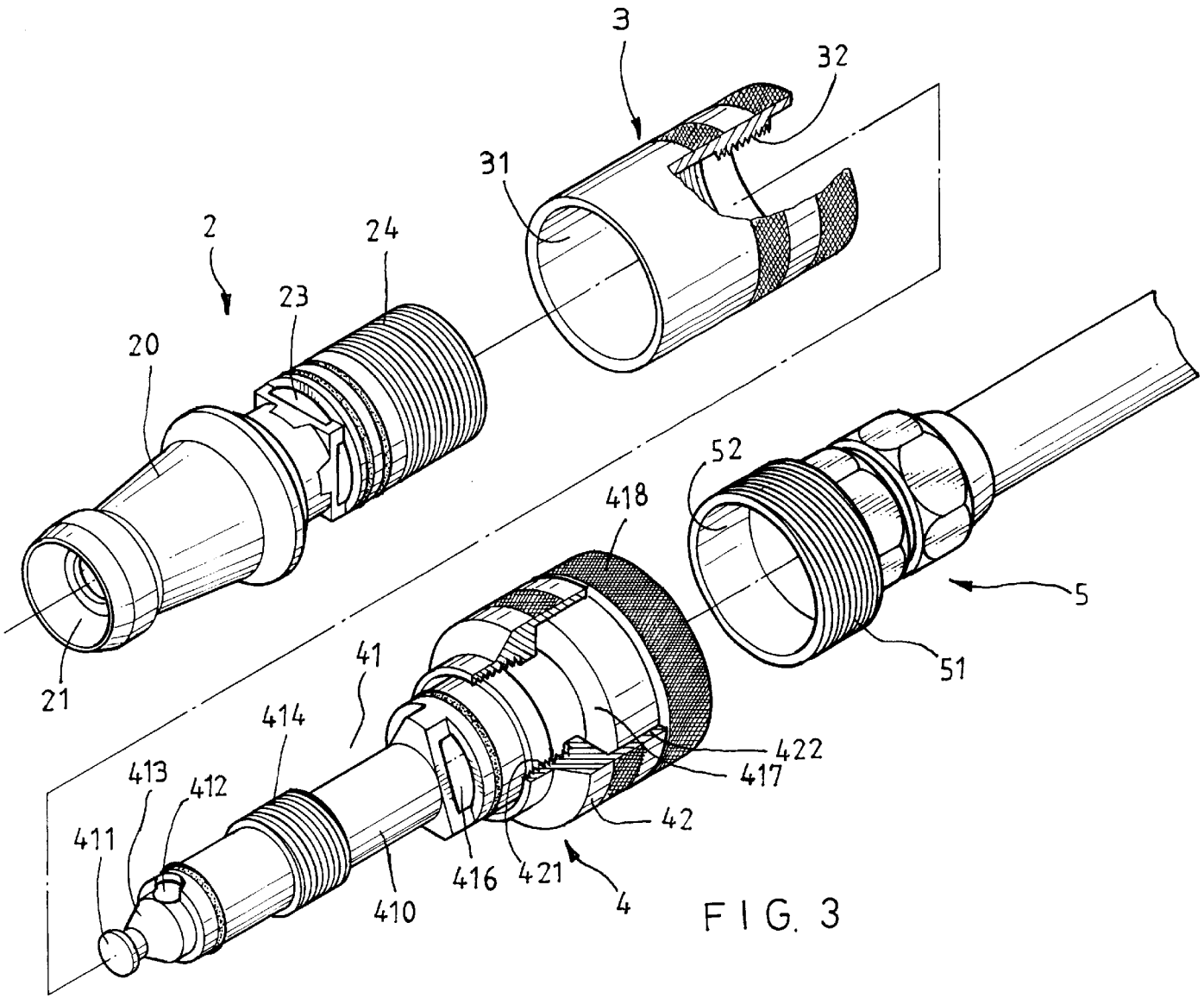
FIG. 3 is an exploded view of the invention.

Referring to FIGS. 2 and 3, the invention mainly includes a spray nozzle 2, an adjusting sleeve 3, a barrel set 4 and a hose connector 5.

The spray nozzle 2 includes a tube 20 which has a hollow chamber 25 with an inner threaded section 251 formed therein. The spray nozzle 2 has a front end forming a first water outlet 21 which has a conical hole with a greater diameter on the outer side. The first water outlet 21 communicates with the hollow chamber 25 through an aperture 22. The tube 20 has at least one opening 23 formed on the middle section and a threaded section 24 on the rear section thereof.

The adjusting sleeve 3 is a duct having an inner opening 31 which has a rear end forming an inner threaded section 32.

The barrel set 4 includes a barrel 41 and an anchor sleeve 42. The barrel 41 has a front section 410 which forms a hollow tube of a smaller diameter and has a hollow chamber 419 inside. It also has a front end which has a fender head 411 and a conical section 413. The conical section 413 has a rear end forming an aperture 412 communicating with the hollow chamber 419. The front section 410 of the barrel 41 has an outer threaded section 414. The barrel 41 further has a middle section with at least one apertures 416 formed thereon and a rear section which has a multi-stage inner stepped section 417 and a turning head 418 with an inner threaded hole formed therein. The anchor sleeve 42 has an inner hole 422 for coupling with the inner stepped section 417 of the barrel 41. The aperture 416 on the middle section of the barrel 41 and the turning head 418 are interposed by a hollow duct which has a front end forming an inner threaded hole 421 of a smaller diameter.

The hose connector 5 has a front end forming an inner hole 52 and an outer threaded section 51 for coupling to the inner screw hole of the turning head 418 of the barrel 41.

Figure 4:
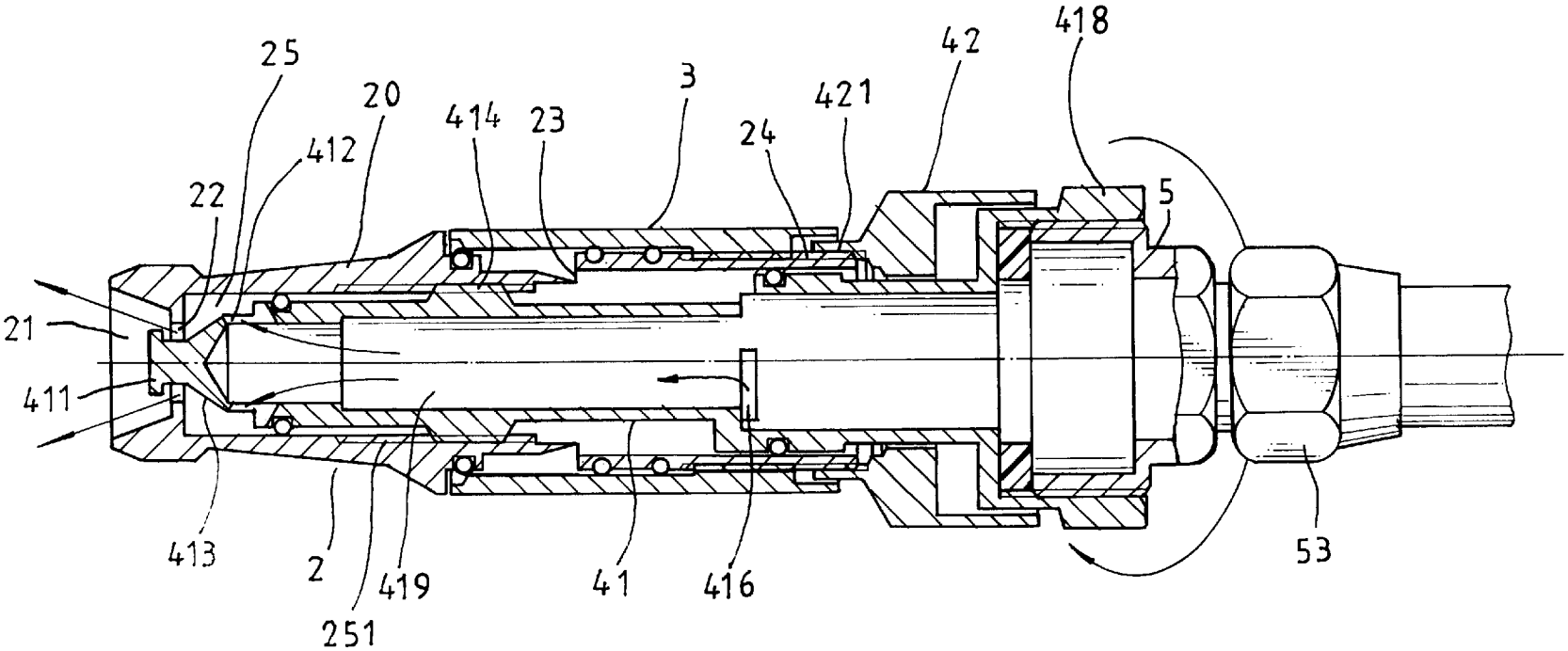
FIG. 4 is a sectional view of the invention.

By means of the construction set forth above, there are two water outlets for spraying water. For watering stronger plants or trees, the turning head 418 may be turned by hands to move the barrel 41 rearwards, and a gap is formed between the fender head 411 and the aperture 22 to allow water to be ejected out through the aperture 416 and the first water outlet 21 (as shown in FIG. 4). To shut off water discharge, turn the turning head 418 in the reverse direction, the conical section 413 blocks the aperture 22 and the first water outlet 21 is closed to stop water discharge.

Figure 5:
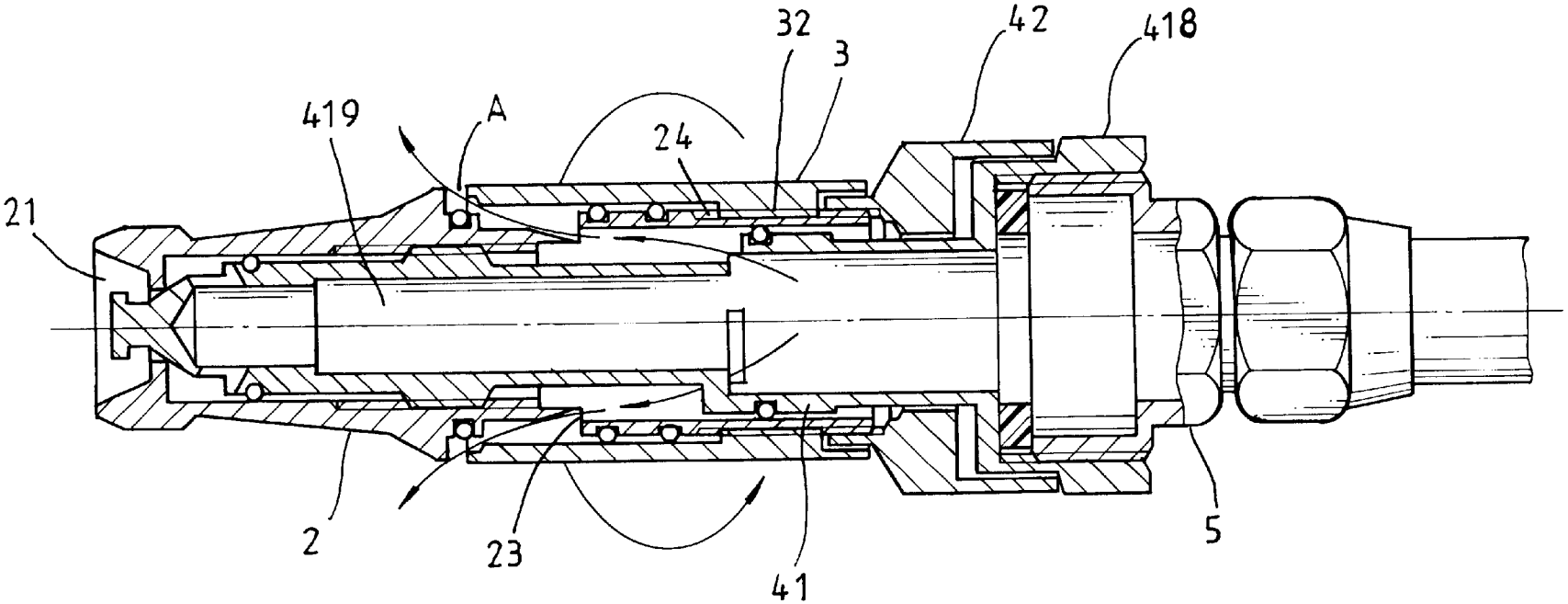
FIG. 5 is another sectional view of the invention.

For watering flowers or plants that are more delicate or fragile, turn the adjusting sleeve 3 rearwards to form a gap between the front rim of the adjusting sleeve 3 and the spray nozzle 2. The gap becomes a second water outlet A to allow water to be discharged through the opening 23 (as shown in FIG. 5). As water is discharged sideward and spraying in an annular fashion, water thrust force is smaller and is more desirable for watering the fragile flowers and plants. Operating in the reverse direction, water discharge may be shut off. Of course, the first and second water outlets 21 and A may also discharge water simultaneously. This may be accomplished by turning the turning head 418 and the adjusting sleeve 3 concurrently.

In summary, the invention can control water discharge according to plant conditions and requirements to prevent plant damages caused by improper watering. It offers a significant improvement over conventional sprinklers.

I claim:

1. An improved sprinkler, comprising:

a spray nozzle being a tube which has a hollow chamber with an inner threaded section formed therein, the spray nozzle further having a front end forming a first water outlet communicating with the hollow chamber through an aperture, the tube having at least one opening formed on a middle section and a threaded section on a rear section thereof;

an adjusting sleeve being a duct having an inner opening which has a rear end forming an inner threaded section;

a barrel set including a barrel and an anchor sleeve, the barrel having a front section which forms a hollow tube of a smaller diameter, a hollow chamber formed in the interior, and a front end which has a fender head and a conical section, the conical section having a rear end forming an aperture communicating with the hollow chamber, the front section of the barrel having an outer threaded section, the barrel further having a middle section with at least one apertures formed thereon and a rear section which has a multi-stage inner stepped section and a turning head with an inner screw hole formed therein, the anchor sleeve being a hollow duct for coupling with the inner stepped section of the barrel; and a hose connector having a front end forming an outer threaded section for coupling to the inner screw hole of the turning head of the barrel.

2. The improved sprinkler of claim 1, wherein the anchor sleeve has a front end which has an inner threaded hole of a smaller diameter.

* * * * *